US009335048B2

(12) United States Patent
Bagchi

(10) Patent No.: US 9,335,048 B2
(45) Date of Patent: May 10, 2016

(54) COMBUSTION CHAMBER OF A GAS TURBINE

(71) Applicant: Rolls-Royce Deutschland Ltd & Co KG, Blankenfelde-Mahlow (DE)

(72) Inventor: Imon Kalyan Bagchi, Melbourne (GB)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 14/643,381

(22) Filed: Mar. 10, 2015

(65) Prior Publication Data

US 2015/0260402 A1 Sep. 17, 2015

(30) Foreign Application Priority Data

Mar. 11, 2014 (DE) ..... 10 2014 204 476

(51) Int. Cl.
*F23R 3/00* (2006.01)
*F23R 3/60* (2006.01)

(52) U.S. Cl.
CPC . *F23R 3/002* (2013.01); *F23R 3/60* (2013.01); *F23R 2900/00017* (2013.01)

(58) Field of Classification Search
CPC ... F23R 3/002; F23R 3/60; F23R 2900/00017
See application file for complete search history.

(56) References Cited

U.S. PATENT DOCUMENTS

| | | | | |
|---|---|---|---|---|
| 3,116,606 | A | 1/1964 | Dougherty et al. | |
| 3,653,207 | A | 4/1972 | Stenger et al. | |
| 4,158,949 | A | 6/1979 | Reider | |
| 4,628,694 | A | 12/1986 | Kelm et al. | |
| 4,912,922 | A * | 4/1990 | Maclin | F23R 3/002 60/757 |
| 4,944,151 | A | 7/1990 | Hovnanian | |
| 5,291,732 | A * | 3/1994 | Halila | F23R 3/60 60/752 |
| 5,435,139 | A | 7/1995 | Pidcock et al. | |
| 5,758,503 | A | 6/1998 | DuBell et al. | |
| 6,453,675 | B1 | 9/2002 | Royle | |
| 7,752,851 | B2 * | 7/2010 | Daguenet | F01D 25/243 60/752 |
| 7,762,075 | B2 | 7/2010 | Pangle et al. | |
| 2005/0086945 | A1 | 4/2005 | Tiemann | |
| 2010/0146985 | A1 | 6/2010 | Buchal et al. | |

(Continued)

FOREIGN PATENT DOCUMENTS

| | | |
|---|---|---|
| DE | 1291554 | 3/1969 |
| DE | 3424345 A1 | 1/1986 |
| DE | 102008002981 A1 | 2/2009 |

(Continued)

OTHER PUBLICATIONS

German Search Report dated Oct. 29, 2014 for counterpart App. No. 10 2014 204 476.6.

(Continued)

*Primary Examiner* — Phutthiwat Wongwian
*Assistant Examiner* — Stefan Ibroni
(74) *Attorney, Agent, or Firm* — Timothy J. Klima; Shuttleworth & Ingersoll, PLC

(57) ABSTRACT

The present invention relates to a combustion chamber of a gas turbine having an outer combustion chamber wall and an inner combustion chamber wall, where the inner combustion chamber wall, at its front end area relative to the direction of flow through the combustion chamber, is fixed to the outer combustion chamber wall and, at its rear end area, is held longitudinally movable at the outer combustion chamber wall.

15 Claims, 5 Drawing Sheets

(56) References Cited

U.S. PATENT DOCUMENTS

Figure 1:
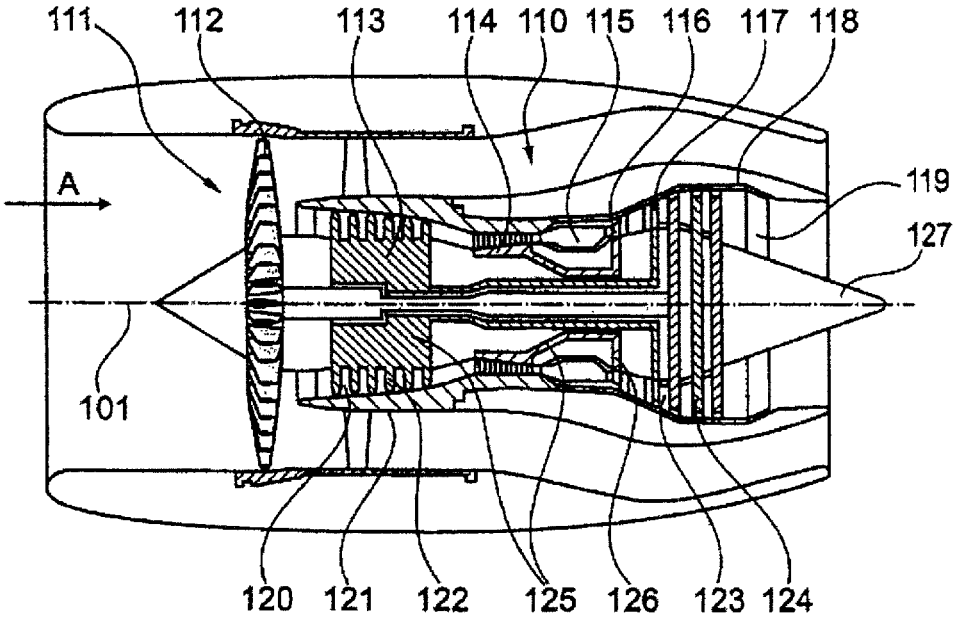

| | | | |
|---|---|---|---|
| 2012/0240584 | A1 | 9/2012 | Berdou et al. |
| 2013/0251941 | A1 | 9/2013 | Garry et al. |

FOREIGN PATENT DOCUMENTS

| | | | |
|---|---|---|---|
| EP | 1284392 | A1 | 2/2003 |
| EP | 1486732 | | 12/2004 |
| EP | 1635118 | | 3/2006 |
| EP | 1767835 | A1 | 3/2007 |
| EP | 1777460 | | 4/2007 |
| EP | 2402659 | A1 | 1/2012 |
| GB | 1089467 | A | 11/1967 |
| GB | 1539035 | | 1/1979 |
| WO | WO2011070273 | A1 | 6/2011 |

OTHER PUBLICATIONS

European Search Report dated Jul. 20, 2015 from related European Application No. 15158435.6.

German Search Report dated Mar. 27, 2014 from related App. No. 10 2014 204 481.2.

European Search Report dated Jul. 13, 2015 for related European App. No. 15158432.3.

* cited by examiner

State of the art

COMBUSTION CHAMBER OF A GAS TURBINE

This application claims priority to German Patent Application DE102014204476.6 filed Mar. 11, 2014, the entirety of which is incorporated by reference herein.

This invention relates to the combustion chamber of a gas turbine. The combustion chamber has an outer combustion chamber wall and an inner combustion chamber wall.

It is known from the state of the art to mount the inner, hot combustion chamber wall on the outer, cold combustion chamber wall in a suitable manner. The two combustion chamber walls are at a distance from one another here, in order to provide an intermediate space for cooling air to flow through. The outer, cold combustion chamber wall here has a plurality of impingement cooling holes, through which cooling air impacts that side of the inner, hot combustion chamber wall facing away from the combustion chamber interior in order to cool it. The inner, hot combustion chamber wall is provided with a plurality of effusion holes through which cooling air exits and contacts the surface of the inner combustion chamber wall in order to cool it and shield it from the hot combustion gases.

Combustion chambers of this type are arranged between a high-pressure compressor and a high-pressure turbine.

The outer, cold combustion chamber wall, which forms a supporting structure, is usually made by welding together prefabricated parts. At the outflow area of the combustion chamber, flanges and combustion chamber suspensions, which are manufactured as separately forged parts, are welded on in order to mount the combustion chamber. The combustion chamber walls themselves are usually designed as sheet-metal structures. At the front end of the combustion chamber, a combustion chamber head with a base plate usually manufactured as a casting is provided. The inner, hot combustion chamber wall is then inserted in the interior of this outer, cold combustion chamber wall and usually consists of tiles which are designed segment-like. The tiles are designed as castings and have integrally cast stud bolts which are passed through recesses of the outer combustion chamber wall and bolted from the outside using nuts.

Designs of this type are previously known for example from U.S. Pat. No. 5,435,139 A or U.S. Pat. No. 5,758,503 A.

Accordingly, with the solutions known from the state of the art, it is always stud bolts that are used to fasten the inner combustion chamber wall (the tiles). To perform this fastening operation in a functionally appropriate manner, it is necessary to pretension the stud bolts using nuts. Due to the high temperature on the side of the hot, inner combustion chamber wall, however, the material of the stud bolts is considerably stressed, so that the material will creep. As a result, the pretensioning of the stud bolts decreases. Consequently, vibrations of the tiles of the inner combustion chamber wall occur, and this can lead to failure of the fastening of the tiles and cause destruction of the entire gas turbine.

Cooling of the tiles in the vicinity of the stud bolts cannot be designed in an optimum way due to the material accumulations occurring there. Higher temperatures therefore occur at the transitional areas from the tiles to the stud bolts, exceeding the temperatures in the remaining areas of the tiles.

A further disadvantage of the previously known solutions is that in the area of the exhaust nozzle of the combustion chamber a seal or sealing lip is provided that seals off the exhaust jet from the surrounding components and routes it to the stator vanes of the high-pressure turbine. These sealing lips become worn when the tiles are loosened or vibrate. What is disadvantageous here is that the sealing lip is designed as part of the supporting structure of the combustion chamber and cannot easily be replaced.

The object underlying the present invention is to provide a combustion chamber of a gas turbine of the type specified at the beginning, which while being simply designed and easily and cost-effectively producible provides a high degree of operational safety and a long service life.

It is a particular object of the present invention to provide solution to the above problems by features described herein. Further advantageous embodiments of the present invention become apparent from the present description.

In accordance with the invention, it is thus provided that the inner combustion chamber wall, at its rear end area relative to the direction of flow through the combustion chamber, is held longitudinally movable in a groove in the area of a combustion chamber suspension or of a sealing lip for a strip seal to an outlet nozzle guide vane (NGV). At its front end area the inner combustion chamber wall is fixed to the outer combustion chamber wall.

With the solution in accordance with the invention, it is possible to design the first, cold combustion chamber wall in the manner as is known from the state of the art, i.e. as a joined sheet-metal part. The inside second, hot combustion chamber wall can be made of a sheet-metal material or in the form of cast segments or tiles. Due to mounting in a groove at the rear end area of the cold combustion chamber wall, it is possible to enable longitudinal movability, which in particular also permits thermal expansions, without there being any risk of damage. At the front end, the inner combustion chamber wall (tile) is fixed in the vicinity of the base plate. This fixing can be performed in accordance with the invention for example using screws or bolts. In accordance with the invention, therefore, a positive fixing is achieved at the front area of the inner combustion chamber wall.

In a particularly favourable embodiment of the present invention it is provided that the inner combustion chamber wall has at its rear end area at least one hook or hook element. The hook is preferably designed U-shaped, so that the rear area of the inner combustion chamber is both held by the hook and guided in a longitudinally movable manner. Several hooks are provided preferably around the circumference of the inner combustion chamber wall. The hooks can furthermore be designed elastic to eliminate any clearances. They have a spring function here, to keep the inner combustion chamber wall (tiles) taut on the outer combustion chamber wall. By designing the hook facing outward and away from the hot, inner area of the inner combustion chamber wall, said hook is located outside the hot gas flow and is thus thermally not so heavily loaded.

In a favourable development of the invention, it can be provided that the inner combustion chamber wall is designed segmented, where its segments can extend over the entire length of the combustion chamber.

The fastening or fixing of the front end of the combustion chamber wall can be adapted in a favourable manner to the respective structural requirements, for example by bolts which are arranged radially relative to the direction of flow or a center axis of the combustion chamber. Alternatively, fastening can be achieved by axially aligned stud bolts manufactured with the tiles. These stud bolts can be fastened with nuts on the cold side of the combustion chamber head plate.

A crucial advantage is achieved in accordance with the invention in that cooling of the inner combustion chamber wall can be designed in an optimum way over its entire surface. Since no stud bolts are present, there are no restrictions either as regards heat transfer.

The combustion chamber in accordance with the invention and in particular the inner combustion chamber wall in accordance with the invention can preferably be made by means of an additive manufacturing method, e.g. by laser depositioning or electron-beam build-up welding. This manufacturability is furthered in that when compared to the state of the art, no fastening bolts or similar are required for mounting of the inner combustion chamber wall. As a result, material accumulations and also geometries which make manufacture more complex are avoided.

A further advantage of the embodiment in accordance with the invention is that it is possible to design the sealing lip to the outlet nozzle guide vane ring such that it can also be replaced in the event of the inner combustion chamber wall being replaced, without the entire combustion chamber structure being affected.

Figure 2:
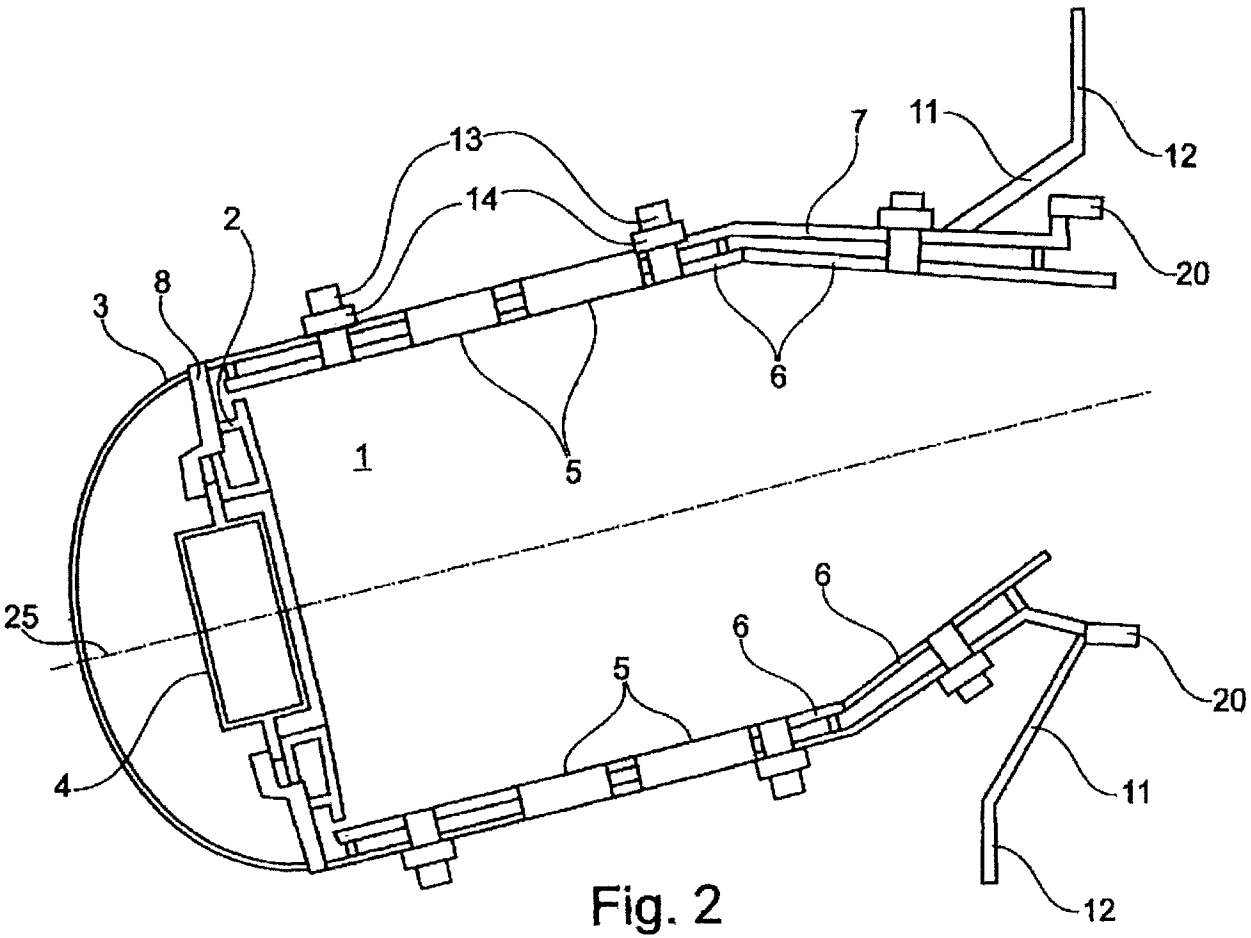
Figure 3:
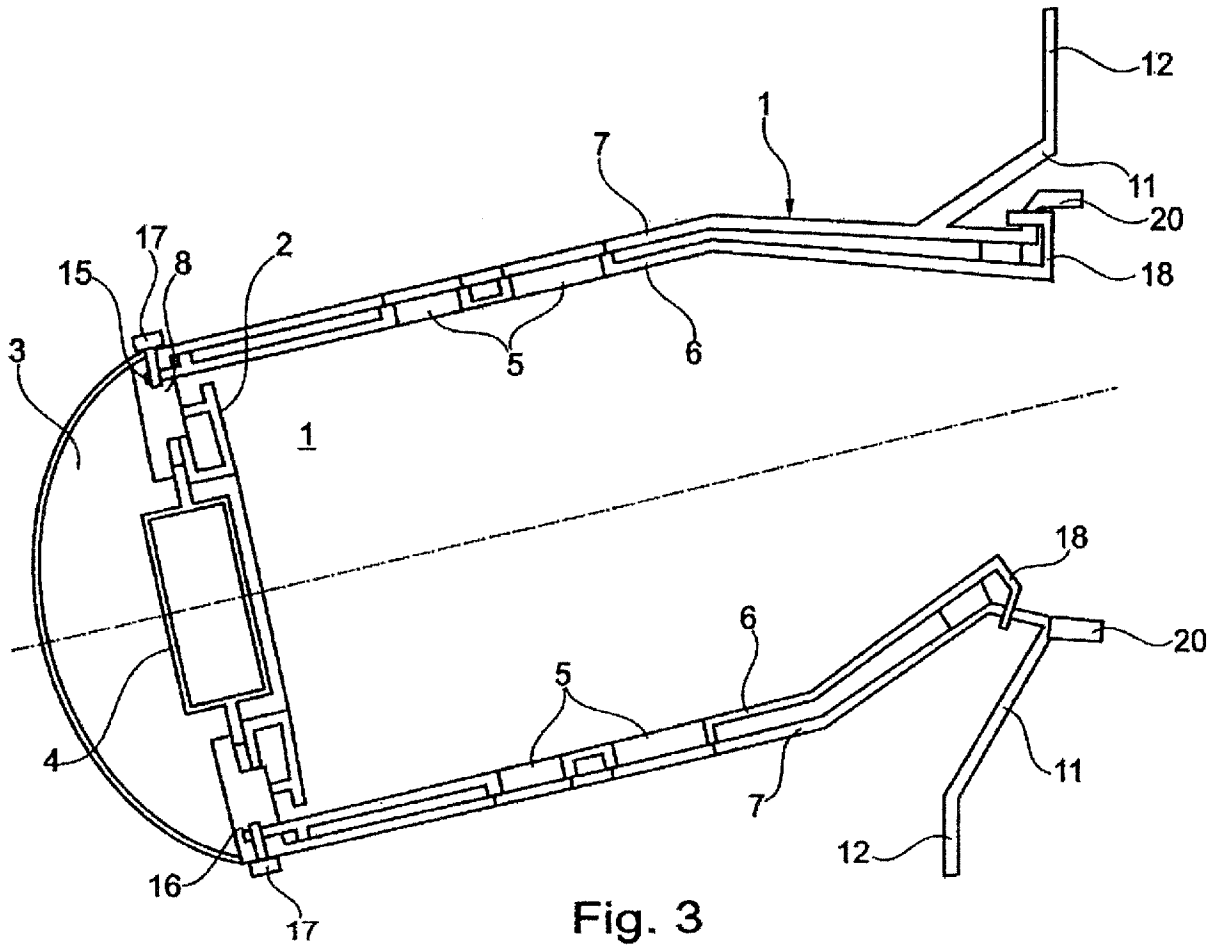
Figure 6:
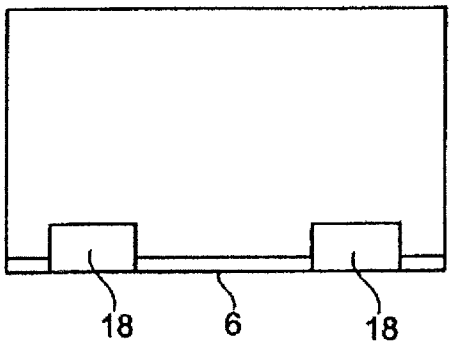
Figure 4:
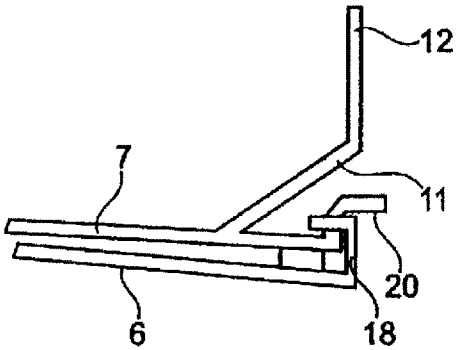
Figure 5:
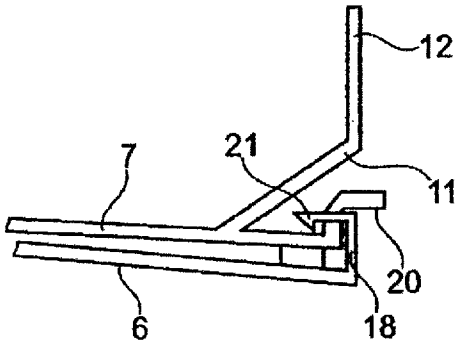
Figure 8:
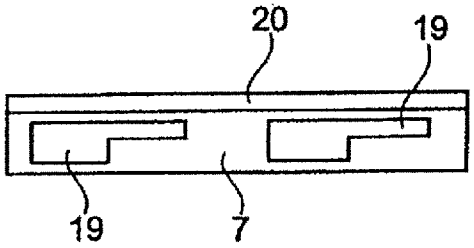
Figure 7:
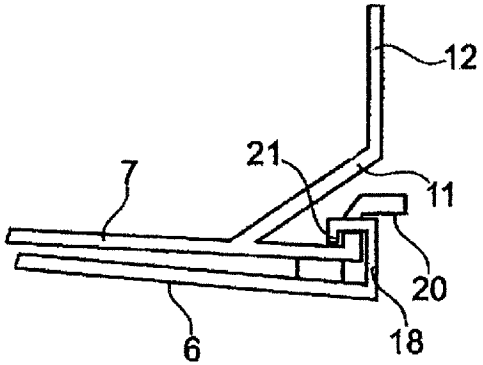

The present invention is described in the following in light of the accompanying drawing showing exemplary embodiments. In the drawing, FIG. 1 shows a schematic representation of a gas-turbine engine in accordance with the present invention, FIG. 2 shows a longitudinal sectional view of a combustion chamber in accordance with the state of the art, FIG. 3 shows a view, by analogy with FIG. 2, of a first exemplary embodiment of the present invention, FIG. 4 shows a simplified detail view of the rear end area of the inner combustion chamber wall and its mounting, FIG. 5 shows a modified exemplary embodiment, by analogy with FIG. 4, FIG. 6 shows a front-side rear view of the exemplary embodiment of FIG. 4, FIGS. 7 and 8 show a further exemplary embodiment with a rear view in analogeous representation to FIGS. 4 and 6, and FIGS. 9 and 10 show a further design variant, by analogy with FIGS. 7 and 8.

The gas-turbine engine 110 in accordance with FIG. 1 is a generally represented example of a turbomachine where the invention can be used. The engine 110 is of conventional design and includes in the flow direction, one behind the other, an air inlet 111, a fan 112 rotating inside a casing, an intermediate-pressure compressor 113, a high-pressure compressor 114, a combustion chamber 115, a high-pressure turbine 116, an intermediate-pressure turbine 117 and a low-pressure turbine 118 as well as an exhaust nozzle 119, all of which being arranged about a center engine axis 101.

The intermediate-pressure compressor 113 and the high-pressure compressor 114 each include several stages, of which each has an arrangement extending in the circumferential direction of fixed and stationary guide vanes 120, generally referred to as stator vanes and projecting radially inwards from the engine casing 121 in an annular flow duct through the compressors 113, 114. The compressors furthermore have an arrangement of compressor rotor blades 122 which project radially outwards from a rotatable drum or disk 125 linked to hubs 126 of the high-pressure turbine 116 or the intermediate-pressure turbine 117, respectively.

The turbine sections 116, 117, 118 have similar stages, including an arrangement of fixed stator vanes 123 projecting radially inwards from the casing 121 into the annular flow duct through the turbines 116, 117, 118, and a subsequent arrangement of turbine blades 124 projecting outwards from a rotatable hub 126. The compressor drum or compressor disk 125 and the blades 122 arranged thereon, as well as the turbine rotor hub 126 and the turbine rotor blades 124 arranged thereon rotate about the engine center axis 101 during operation.

FIG. 2 shows a longitudinal sectional view of a combustion chamber wall known from the state of the art in enlarged representation. Here, a combustion chamber 1 with a center axis 25 is shown, which includes a combustion chamber head 3, a base plate 8 and a heat shield 2. A burner seal is identified by the reference numeral 4. The combustion chamber 1 has an outer, cold combustion chamber wall 7, to which an inner, hot combustion chamber wall 6 is attached. Admixing holes 5 are provided for supplying mixing air. For greater clarity, a representation of impingement cooling holes and effusion holes was dispensed with.

The inner combustion chamber wall 6 is provided with bolts 13, designed as threaded bolts and bolted using nuts 14. At the outflow-side end of the combustion chamber 1, a sealing lip 20 for a strip seal to the outlet nozzle guide vane is provided. The combustion chamber 1 is mounted using combustion chamber flanges 12 and combustion chamber suspensions 11.

In the following exemplary embodiments the same reference numerals are used for identifying identical parts. Identical parts and identical aspects of the solution are not described again in detail for varying exemplary embodiments; instead reference is made in this respect to the text of the other exemplary embodiments.

FIG. 3 shows a first exemplary embodiment of a combustion chamber in accordance with the present invention. The latter is basically designed as the combustion chamber shown in FIG. 2. This means that it also has an outer, cold combustion chamber wall 7 and an inner, hot combustion chamber wall 6. Mounting is also achieved using combustion chamber suspensions 11 and combustion chamber flanges 12. The sealing lip 20 too is shown accordingly. At the front end, a combustion chamber head 3, a heat shield 2, a base plate 8 and a burner seal 4 are provided.

As shown in FIG. 3, the base plate 8 is provided with a groove 16, preferably an annular groove, into which the head-side end 15 of the inner, hot combustion chamber wall 6 is inserted. The head-side end 15 is firmly fixed by means of fastening bolts 17. As an alternative to the bolts, fixing is also possible with other positive connecting elements. In the case of fixing using the bolts 17, the base plate 8 has threaded recesses into which the bolts 17 are screwed.

At the rear end area, the inner combustion chamber wall 6 is provided with radially outward-facing hooks 18 which are guided in a longitudinally movable manner inside recesses 19 of the outer combustion chamber wall 7. The hooks 18 can be mounted directly on the outer combustion chamber wall 7 or in the area of a sealing lip 20 of a strip seal to an outlet nozzle guide vane (NGV).

FIGS. 4, 5, 7 and 9 each show different design variants for mounting the rear end area of the inner combustion chamber wall 6. FIG. 4 illustrates in enlarged representation the solution shown in FIG. 3. The rear view in FIG. 6 makes clear that a plurality of hooks 18 can be provided spread over the circumference of the inner combustion chamber wall 6.

Figure 10:
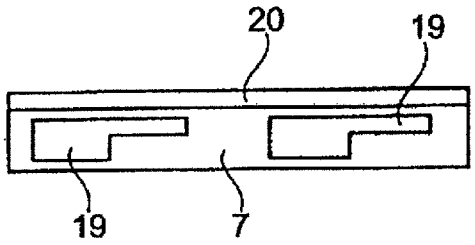
Figure 9:
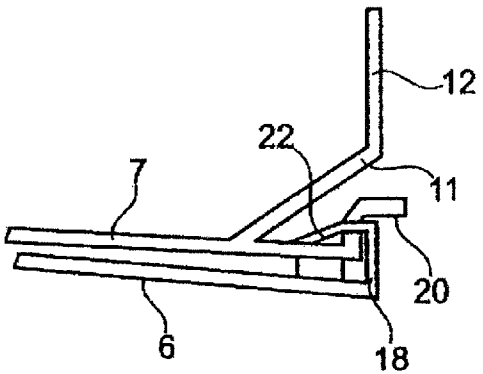

In the exemplary embodiment of FIG. 5, a securing projection 21 is additionally provided at the free end of the hook 18 and in particular facilitates fitting of the inner combustion chamber wall 6 and prevents loosening of the hook 18. A similar design is shown in FIG. 7. To insert the hook 18 into the recess 19, the latter is provided with a staged cross-section, as is shown by FIG. 8. By rotating it in the circumferential direction, the hook 18 enters the right-hand area of the recess 19 as shown in the representation of FIG. 8, so that the hook 18 is securely engaged using its securing projection 21. The exemplary embodiment in FIGS. 9 and 10 shows an elastic projection 22 provided at the free end of the hook 18 and contacting the outer combustion chamber wall 7 in order to pretension the inner combustion chamber wall without any clearances.

LIST OF REFERENCE NUMERALS

1 Combustion chamber
2 Heat shield
3 Combustion chamber head
4 Burner seal
5 Admixing hole
6 Inner, hot combustion chamber wall/segment/tile
7 Outer, cold combustion chamber wall
8 Base plate
9 Impingement cooling hole
10 Effusion hole
11 Combustion chamber suspension
12 Combustion chamber flange
13 Bolt
14 Nut
15 Head-side end of inner, hot combustion chamber wall 6
16 Groove in base plate 8
17 Fastening bolt
18 Hook
19 Recess
20 Sealing lip
21 Securing projection
22 Elastic projection
101 Engine center axis
110 Gas-turbine engine/core engine
111 Air inlet
112 Fan
113 Intermediate-pressure compressor (compressor)
114 High-pressure compressor
115 Combustion chamber
116 High-pressure turbine
117 Intermediate-pressure turbine
118 Low-pressure turbine
119 Exhaust nozzle
120 Guide vanes
121 Engine casing
122 Compressor rotor blades
123 Stator vanes
124 Turbine blades
125 Compressor drum or disk
126 Turbine rotor hub
127 Exhaust cone

What is claimed is:

1. A combustion chamber of a gas turbine, comprising:

an outer combustion chamber wall;

an inner combustion chamber wall including a front end area and a rear end area relative to a direction of flow through the combustion chamber, where the front end area is fixed to the outer combustion chamber wall and the rear end area is held longitudinally movable at the outer combustion chamber wall;

wherein the rear end area includes at least one hook, which in an assembled state between the inner combustion chamber and the outer combustion chamber, longitudinally movably engages at least one chosen from the outer combustion chamber wall and a sealing lip for a seal of an outlet nozzle guide vane;

wherein the at least one chosen from the outer combustion chamber wall and the sealing lip includes at least one recess for receiving the at least one hook;

wherein the at least one recess has a stepped shape in a circumferentially extending direction, the stepped shape including a wide portion circumferentially connected to a narrow portion, the wide portion for insertion of the at least one hook and the narrow portion for retention of the at least one hook, the narrow portion engaging the at least one hook upon a respective circumferential rotation between the at least one hook and the at least one recess.

2. The combustion chamber in accordance with claim 1, wherein the front end area is positively fixed with respect to the outer combustion chamber wall.

3. The combustion chamber in accordance with claim 1, wherein the rear end area is mounted proximate to the sealing lip.

4. The combustion chamber in accordance with claim 1, wherein the at least one hook is U-shaped and is held longitudinally movable inside at least one recess of the outer combustion chamber wall.

5. The combustion chamber in accordance with claim 4, wherein the at least one U-shaped hook includes a plurality of U-shaped hooks positioned around a circumference of the rear end area.

6. The combustion chamber in accordance with claim 4, wherein the hook is elastic to eliminate clearance between the at least one hook and the at least one chosen from the outer combustion chamber wall and the sealing lip.

7. The combustion chamber in accordance with claim 1, wherein a front end area of the inner combustion chamber wall is held in a groove of a base plate.

8. The combustion chamber in accordance with claim 1, wherein the inner combustion chamber wall is segmented.

9. The combustion chamber in accordance with claim 1, wherein the inner combustion chamber wall is at least one chosen from formed as a tile and includes tiles.

10. The combustion chamber in accordance with claim 1, wherein the inner combustion chamber wall is an assembly formed by an additive manufacturing method.

11. The combustion chamber in accordance with claim 1, wherein the at least one hook includes a securing projection positioned at an angle with respect to a distal end of the at least one hook for securing the at least one hook with respect to the at least one recess.

12. The combustion chamber in accordance with claim 11, wherein the at least one recess is positioned in the sealing lip.

13. The combustion chamber in accordance with claim 11, wherein the at least one recess is positioned in the outer combustion chamber wall.

14. The combustion chamber in accordance with claim 1, wherein the at least one hook includes a securing projection positioned at an angle with respect to a distal end of the at least one hook for securing the at least one hook with respect to the at least one recess.

15. The combustion chamber in accordance with claim 1, wherein the at least one hook includes a securing projection positioned at an angle with respect to a distal end of the at least one hook for securing the at least one hook with respect to the at least one chosen from the outer combustion chamber wall and the sealing lip.

* * * * *